US008663403B2

(12) United States Patent
Chen et al.

(10) Patent No.: US 8,663,403 B2
(45) **Date of Patent: *Mar. 4, 2014**

(54) HIGH CORROSION RESISTANCE PRECIPITATION HARDENED MARTENSITIC STAINLESS STEEL

(75) Inventors: Jianqiang Chen, Greer, SC (US); Thomas Michael Moors, Simpsonville, SC (US); Jon Conrad Schaeffer, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 138 days.

This patent is subject to a terminal disclaimer.

(21) Appl. No.: 13/155,775

(22) Filed: Jun. 8, 2011

(65) Prior Publication Data

US 2011/0232809 A1 Sep. 29, 2011

Related U.S. Application Data

(63) Continuation-in-part of application No. 12/365,335, filed on Feb. 4, 2009, now Pat. No. 7,985,306.

(51) Int. Cl.

| | |
|---|---|
| ***C21D 6/02*** | (2006.01) |
| ***C22C 38/42*** | (2006.01) |
| ***C22C 38/44*** | (2006.01) |

(52) U.S. Cl.

USPC ..... 148/607; 148/326; 148/605; 148/606; 420/34; 420/60; 420/61; 420/67

(58) Field of Classification Search

USPC ..... 148/320, 325–327, 605–611; 420/34, 420/60, 61, 67, 89–92, 119, 123

See application file for complete search history.

(56) References Cited

U.S. PATENT DOCUMENTS

| | | | |
|---|---|---|---|
| 3,574,601 | A | 4/1971 | Myers et al. |
| 6,743,305 | B2 | 6/2004 | Short |
| 7,767,039 | B2 | 8/2010 | Kondo et al. |
| 2003/0102057 | A1 | 6/2003 | Short |

FOREIGN PATENT DOCUMENTS

| | | | | |
|---|---|---|---|---|
| CN | 1816639 | A | 8/2006 | |
| DE | 2700574 | A1 * | 7/1977 | ..... C21D 7/13 |
| EP | 0649915 | A1 | 4/1995 | |
| JP | 05331600 | | 12/1993 | |

(Continued)

OTHER PUBLICATIONS

English language machine translation of JP 08-144023 to Yokota et al. Generated Jul. 7, 2010.*

(Continued)

*Primary Examiner* — Brian Walck
(74) *Attorney, Agent, or Firm* — Cantor Colburn LLP

(57) ABSTRACT

A precipitation-hardened stainless steel alloy comprises, by weight: about 14.0 to about 16.0 percent chromium; about 6.0 to about 8.0 percent nickel; about 1.25 to about 1.75 percent copper; greater than about 1.5 to about 2.0 percent molybdenum; about 0.001 to about 0.025 percent carbon; niobium in an amount greater than about twenty times that of carbon; and the balance iron and incidental impurities. The alloy has an aged microstructure and an ultimate tensile strength of at least about 1100 MPa and a Charpy V-notch toughness of at least about 69 J. In one embodiment, the aged microstructure includes martensite and not more than about 10% reverted austenite. In another embodiment, the alloy includes substantially all martensite and substantially no reverted austenite. The alloy is useful for making turbine airfoils.

20 Claims, 11 Drawing Sheets

Nb/C=20.2, Mo=2.0 wt. %

(56) References Cited

FOREIGN PATENT DOCUMENTS

| | | | |
|---|---|---|---|
| JP | 8144023 | A | 6/1996 |
| JP | 2001279385 | | 10/2001 |
| WO | 200179576 | A1 | 10/2001 |

OTHER PUBLICATIONS

"Precipitation-Hardening Martensitic Stainless Steels." ASM Handbook. 2002.

J. Janovec, B. Sustarsic, J. Medved, M. Jenko, "Phases in Austenitic Stainless Steels", Materiali in Tehnologije, 37 (2003) 6, pp. 307-312.

Search Report Issued in CN Application 201010119124.3 dated Dec. 20, 2012.

English Translation for Office Action, CN 201010119124.3 dated Sep. 3, 2013, 4 pages.

* cited by examiner

Nb/C = 10.3, 1020°F Aging

Nb/C = 17.7, 1020°F Aging

Nb/C = 10.3, 1150°F Aging

Nb/C = 17.7, 1150°F Aging

Nb/C=9.4, Mo=0.62 wt %

Nb/C=9.4, Mo=2.0 wt. %

Nb/C=20.2, Mo=2.0 wt. %

Nb/C=20.2, Mo=0.62 wt. %

Specimens After Accelerated Salt Fog Test Per ASTM G85 A4
5%NaCl Fog Solution Purged with $SO_2$, pH 3.0

Exposure Duration = 480 hours

GTD450
Mo=0.62 wt.%,
Nb/C=9.4

GTD450
Mo=2.0 wt.%,
Nb/C=20

Exposure Duration =1440 hours

GTD450
Mo=0.62 wt.%,
Nb/C=9.4

GTD450
Mo=2.0 wt.%,
Nb/C=20

GTD450: Nb/C=100, Mo=1.8%

GTD450: Nb/C=78, Mo=1.9%

HIGH CORROSION RESISTANCE PRECIPITATION HARDENED MARTENSITIC STAINLESS STEEL

RELATED APPLICATION

This application is a Continuation-in-Part of co-pending U.S. patent application Ser. No. 12/365,335, filed on Feb. 4, 2009, which is hereby incorporated herein by reference in its entirety.

BACKGROUND OF THE INVENTION

The subject matter disclosed herein relates generally relates to high strength stainless steels. More particularly, it relates to a precipitation-hardened, martensitic, stainless steel suitable for turbine rotating components.

The metal alloys used for rotating components of a gas turbine, particularly the compressor airfoils, including rotating and stationary blades, must have a combination of high strength, toughness, fatigue resistance and other physical and mechanical properties in order to provide the required operational properties of these machines. In addition, the alloys used must also have sufficient resistance to various corrosion damage due to the extreme environments in which turbines are operated, including exposure to various ionic reactant species, such as various species that include chlorides, sulfates, nitrides and other corrosive species. Corrosion can also diminish the other necessary physical and mechanical properties, such as the high cycle fatigue strength, by initiation of surface cracks that propagate under the cyclic thermal and operational stresses associated with operation of the turbine.

Various high strength stainless steel alloys have been proposed to meet these and other requirements, particularly at a cost that permits their widespread use. For example, U.S. Pat. No. 3,574,601 (the "'601 patent") discloses the compositional and other characteristics of a precipitation hardenable, essentially martensitic stainless steel alloy, now known commercially as Carpenter Custom 450, and focuses on corrosion resistance and mechanical properties of this alloy. Ultimate tensile strengths (UTS) of 143-152.5 ksi (about 986-1050 MPa) in the annealed (1700-2100° F. (926-1148° C.) for 0.5-1 hour) or non-aged condition are reported for the alloy compositions described in the patent. The literature regarding this alloy reports an aging temperature range for precipitation hardening of about 800 to 1000° F. (about 427 to 538° C.) for 2-8 hours, with aging at about 900° F. (about 480° C.) producing the maximum strength but lowest fracture toughness. The literature also reports a UTS of greater than 175 ksi (1200 MPa) after aging at 900 to 950° F. (about 480 to about 510° C.). The Custom 450 alloy contains chromium, nickel, molybdenum and copper, as well as other potential alloying constituents such as carbon and niobium (columbium), to yield an essentially martensitic microstructure, having small amounts of less than 10% retained austenite and 1-2% or less of delta ferrite. Niobium may be added at a weight ratio of up to 10 times relative to carbon, if carbon is present in an amount above 0.03 weight percent. The alloys were tested for resistance to boiling 65% by weight nitric acid, room temperature sulfuric acid and hydrogen embrittlement and found to have superior resistance to 300 series and other 400 series stainless steel alloys.

In another example, U.S. Pat. No. 6,743,305 (the "'305 patent") describes an improved stainless steel alloy suitable for use in rotating steam turbine components that exhibits both high strength and toughness as a result of having particular ranges for chemistry, tempering temperatures and grain size. The alloy of this invention is a precipitation-hardened stainless steel, in which the hardening phase includes copper-rich intergranular precipitates in a martensitic microstructure. Required mechanical properties of the alloy include an ultimate tensile strength (UTS) of at least 175 ksi (about 1200 MPa), and a Charpy impact toughness of greater than 40 ft-lb (about 55 J). The '305 patent describes a precipitation-hardened, stainless steel alloy comprising, by weight, 14.0 to 16.0 percent chromium, 6.0 to 7.0 percent nickel, 1.25 to 1.75 percent copper, 0.5 to 1.0 percent molybdenum, 0.03 to 0.5 percent carbon, niobium in an amount by weight of ten to twenty times greater than carbon, the balance iron, minor alloying constituents and impurities. Maximum levels for the minor alloying constituents and impurities are, by weight, 1.0 percent manganese, 1.0 percent silicon, 0.1 percent vanadium, 0.1 percent tin, 0.030 percent nitrogen, 0.020 percent phosphorus, 0.025 percent aluminum, 0.008 percent sulfur, 0.005 percent silver, and 0.005 percent lead.

While the precipitation hardenable, martensitic stainless steels described above have provided the corrosion resistance, mechanical strength and fracture toughness properties described and are suitable for use in rotating steam turbine components, these alloys are still known to be susceptible to both intergranular corrosion attack (IGA) and corrosion pitting phenomena. For example, stainless steel airfoils, such as those used in the compressors of industrial gas turbines, have shown susceptibility to IGA, stress corrosion cracking (SCC) and corrosion pitting on the surfaces, particularly the leading edge surface, of the airfoil. These are believed to be associated with various electrochemical reaction processes enabled by the airborne deposits, especially corrosive species present in the deposits and moisture from intake air on the airfoil surfaces. Electrochemically-induced intergranular corrosion attack (IGA) and corrosion pitting phenomena occurring at the airfoil surfaces can in turn result in cracking of the airfoils due to the cyclic thermal and operating stresses experienced by these components. High level of moisture can result from use of on-line water washing, fogging and evaporative cooling, or various combinations of them, to enhance compressor efficiency. Corrosive contaminants usually result from the environments in which the turbines are operating because they are frequently placed in highly corrosive environments, such as those near chemical or petrochemical plants where various chemical species may be found in the intake air, or those at or near ocean coastlines or other saltwater environments where various sea salts may be present in the intake air, or combinations of the above, or in other applications where the inlet air contains corrosive chemical species. Due to the significant operational costs associated with downtime of an industrial gas turbine, including the cost of purchased power to replace the output of the turbine, as well as the cost of dismantling the turbine to effect repair or replacement of the airfoils and the repair or replacement costs of the airfoils themselves, enhancements of the IGA resistance or pitting corrosion resistance, or both, have a significant commercial value.

In view of the above, stainless steel alloys suitable for use in turbine airfoils, particularly industrial gas turbine airfoils, in the operating environments described and having improved resistance to IGA, or corrosion pitting, or preferably both of them, are desirable and commercially valuable, and provide a competitive advantage.

BRIEF DESCRIPTION OF THE INVENTION

According to one aspect of the invention, a precipitation-hardened stainless steel alloy comprises, by weight: about 14.0 to about 16.0 percent chromium; about 6.0 to about 8.0 percent nickel; about 1.25 to about 1.75 percent copper; greater than about 1.5 to about 2.0 percent molybdenum; about 0.001 to about 0.025 percent carbon; about 0.5 to about 1.0 percent niobium; niobium in an amount greater than about twenty times that of carbon and the balance iron and incidental impurities.

According to yet another aspect of the invention, a method of making a precipitation-hardened stainless steel alloy, includes: providing a precipitation-hardened stainless steel alloy comprising, by weight: about 14.0 to about 16.0 percent chromium; about 6.0 to about 8.0 percent nickel; about 1.25 to about 1.75 percent copper; greater than 1.5 to about 2.0 percent molybdenum; about 0.001 to about 0.025 percent carbon; about 0.5 to about 1.0 percent niobium; niobium in an amount greater than about twenty times that of carbon and the balance iron and incidental impurities; solution heat treating the alloy at a solutionizing temperature and time sufficient to solutionize the alloy constituents; cooling the alloy to a cryogenic temperature following the solution heat treating and prior to aging the alloy; aging the alloy at an aging temperature sufficient to form precipitates configured to provide precipitation hardening of the alloy, wherein the alloy has a microstructure comprising substantially all martensite, an ultimate tensile strength of at least about 1100 MPa and Charpy V-notch toughness of at least about 69 J.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
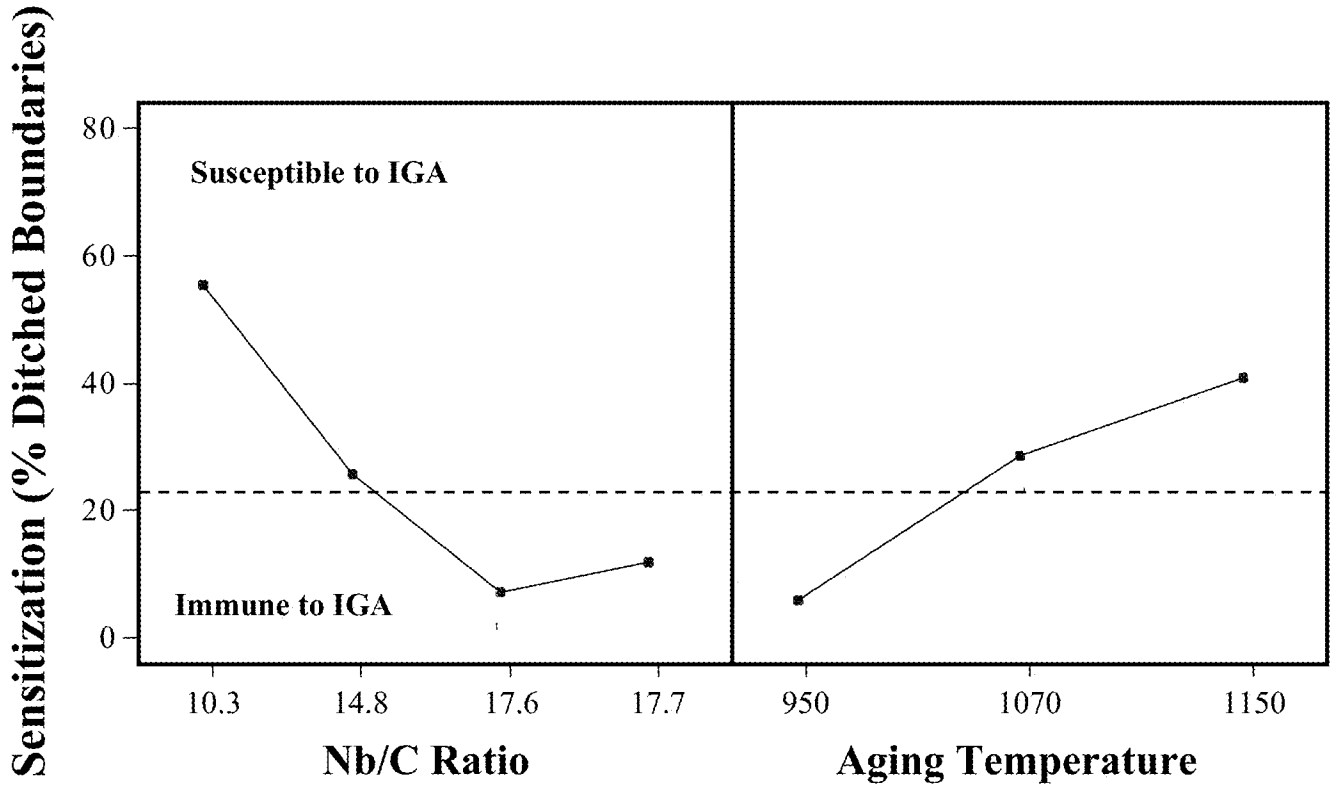
FIG. 1 is a main effects plot of alloy susceptibility to IGA (ditched grain boundary percentage) as a function of the Nb/C ratio and aging temperature for alloy compositions as disclosed herein.
Figure 2A:
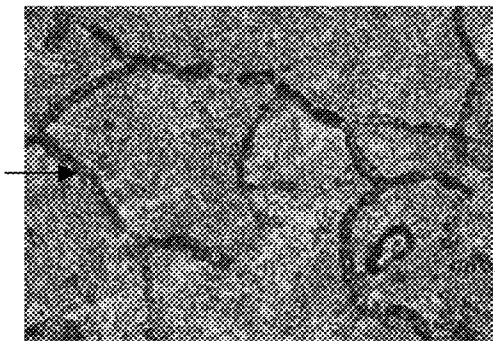
FIGS. 2A-2D show the susceptibility of the alloy microstructure to IGA (affected vs immune), as a function of the Nb/C ratio and aging temperature for alloy compositions as disclosed herein.
Figure 2C:
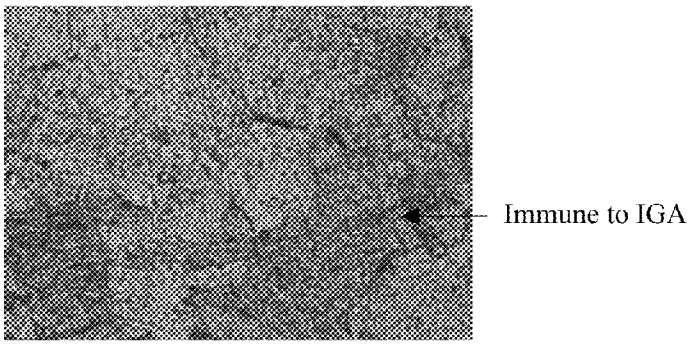
Figure 2B:
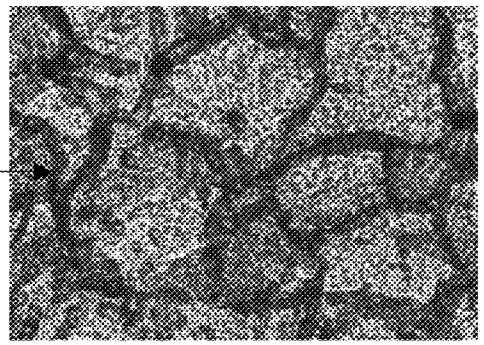
Figure 2D:
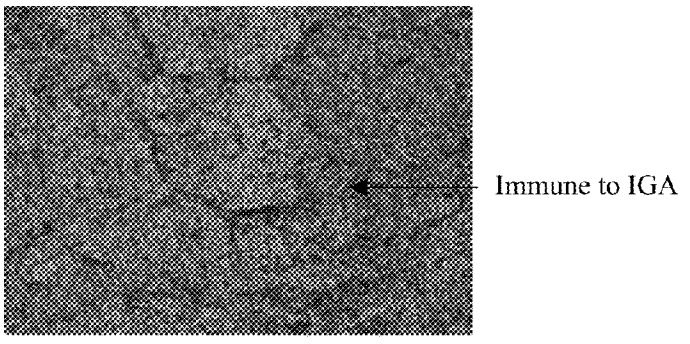

The detailed description explains embodiments of the invention, together with advantages and features, by way of example with reference to the drawings.

DETAILED DESCRIPTION OF THE INVENTION

An improved precipitation hardened, martensitic stainless steel alloy exhibits improved IGA and pitting corrosion resistance and high mechanical strength and fracture toughness through control of the alloy constituents and their relative amounts and an aging heat treatment. The alloy is immune to IGA in known aqueous corrosion environments, and highly resistant to corrosion pitting and other generic corrosion mechanisms and has a minimum ultimate tensile strength after solution, cryogenic and aging heat treatments of at least about 1100 MPa (160 ksi) and has a Charpy V-notch toughness of at least about 50 ft-lb (69 J). This alloy is characterized by a uniform martensite microstructure with dispersed hardening precipitate phases, including fine copper-rich precipitates, and in one embodiment about 10% by weight or less of reverted austenite, and in other embodiments substantially no reverted austenite and substantially all martensite, which in combination with certain chemistry and processing requirements yields the desired corrosion resistance, mechanical strength and fracture toughness properties for the alloy. The alloy exhibits an ultimate tensile strength in the solution, cryogen treated and aged condition of at least about 160 ksi (about 1100 MPa), and in one embodiment in excess of about 170 ksi (about 1172 MPa), and a Charpy impact toughness of at least about 50 ft-lb (about 69 J), and in one embodiment in excess of about 100 ft-lb (about 138 J). Cryogenic cooling following solution heat treatment and prior to the aging heat treatment may be used to increase the tensile strength and impact toughness of these alloys.

In summary, Applicants have discovered that control of the amount of niobium relative to carbon, the Nb/C ratio, at levels that are higher than previously known provides an unexpected benefit in that it makes the alloy increasingly resistant to IGA, and at the highest Nb/C ratios, virtually immune to IGA. For example, from an Nb/C ratio of about 14 to about 17, and even further, from about 14 to about 20, the resistance to IGA steadily improves with increasing amounts of Nb relative to C. Unexpectedly, at Nb/C ratios greater than about 20, more particularly greater than about 20 to about 1000, and even more particularly about 20 to about 500, the alloy has demonstrated IGA resistance that suggests that the alloy is virtually immune to IGA with regard to the reactant species that are typically encountered during operation of the turbine, including the species that are used in the ASTM tests used to evaluate IGA resistance. This transition from steadily improving IGA resistance at Nb/C ratios of about 14 to about 20, to virtual immunity at Nb/C ratios of about >20, is an unexpected and commercially valuable result. Further, Applicants have determined that improvements to the IGA resistance by incorporation of Nb in the amounts relative to C indicated can be done while maintaining a desirable mechanical strength and fracture toughness, including a minimum ultimate tensile strength and a minimum Charpy V-notch toughness after solution, cryogenic and aging heat treatments of greater than about 1100 MPa and about 69 J, respectively.

In addition to the improvement in IGA resistance, Applicants have also discovered that the use of amounts of Mo above those previously known provides a significant improvement in the resistance to pitting corrosion and other non-IGA related corrosion phenomena. For example, in amounts greater than about 1% up to about 2%, by weight of the alloy, the pitting corrosion resistance is improved over the pitting corrosion resistance associated with known amounts for Mo that range from about 0.5% up to about 1%, by weight of the alloy. These amounts of Mo also do not promote undesirable amounts of ferrite, including delta ferrite, as evidenced by a desirable mechanical strength and fracture toughness, including a minimum ultimate tensile strength and a minimum Charpy V-notch toughness after solution and age heat treatments of greater than about 1100 MPa and about 69 J, respectively. More particularly, amounts greater than about 1.5% up to about 2.0%, by weight of the alloy, provide a desirable balance of pitting corrosion protection, alloy cost and a reduced propensity for stabilization of undesirable ferrite phases, since Mo is generally more expensive relative to the other major constituents of the alloy and in higher concentrations has an increased propensity for stabilization of undesirable ferrite phases, including delta ferrite. Even further, amounts greater than about 1.5% up to about 2.0%, by weight of the alloy, provide effective pitting corrosion protection and a more desirable alloy cost and further reduced propensity for formation of ferrite phases for the reasons noted. Further, as described above, Applicants have determined that improvements to the pitting corrosion resistance by incorporation of Mo in the amounts indicated can be done while maintaining a desirable mechanical strength and fracture toughness, including a minimum ultimate tensile strength and a minimum Charpy V-notch toughness after solution, cryogenic and aging heat treatments of greater than about 1100 MPa and about 69 J, respectively.

Several suitable embodiments of the alloy composition for the stainless steel alloy of this invention are summarized in Table 1 below. These embodiments are illustrated together with the alloy composition provided in the '305 patent as well as the composition of a commercial alloy, GTD 450, which is used by the assignee of this application for the manufacture of turbine airfoils, including turbine blades and vanes, used in the compressor section of industrial gas turbines and other applications, for comparison.

As shown in Table 1, in a first embodiment, this alloy comprises, by weight: about 14.0 to about 16.0 percent chromium; about 6.0 to about 7.0 percent nickel; about 1.25 to about 1.75 percent copper; about 0.5 to about 2.0 percent molybdenum; about 0.025 to about 0.05 percent carbon; niobium in an amount greater than about twenty times to about twenty-five times that of carbon, and the balance essentially iron and incidental impurities. The most common incidental impurities include Mn, Si, V, Sn, N, P, S, Al Ag and Pb, generally in controlled amounts of less than about 1% or less by weight of the alloy for any one constituent and less than about 2.32% in any combination; however, the embodiment of the alloy described may include other incidental impurities in amounts which do not materially diminish the alloy properties as described herein, particularly the resistance to intergranular corrosion attack and corrosion pitting, tensile strength, fracture toughness and microstructural morphologies described herein. More particularly, the incidental impurities may also consist essentially of, by weight, up to about 1.0% Mn, up to about 1.0% Si, up to about 0.1% V, up to about 0.1% Sn, up to about 0.03% N, up to about 0.025% P, up to about 0.005% S, up to about 0.05% Al, up to about 0.005% Ag, and up to about 0.005% Pb. The general purposes of the alloy constituents and their amounts, as well as the incidental impurities and their amounts are discussed further below.

TABLE 1

| Element | '305 Patent | GTD 450 | Embodiment 1 | Embodiment 2 | Embodiment 3 |
|---|---|---|---|---|---|
| Cr | 14.0-16.0 | 14.0-16.0 | 14.0-16.0 | 14.0-16.0 | 14.0-16.0 |
| Ni | 6.0-7.0 | 6.0-7.0 | 6.0-7.0 | 6.0-7.0 | 6.0-8.0 |
| Cu | 1.25-1.75 | 1.25-1.75 | 1.25-1.75 | 1.25-1.75 | 1.25-1.75 |
| Mo (Nom.) | 0.5-1.0 | 0.5-1.0 | 0.5-2.0 | >1.0-2.0 | >1.5-2.0 |
| (Pref.) | | | 0.5-1.0 | >1.0-1.75 | |
| (More Pref.) | | | >1.0-2.0 | >1.5-1.75 | |
| C | 0.03-0.050 | 0.025-0.050 | 0.025-0.050 | 0.025-0.050 | 0.001-0.025 |
| Cb (Nb)/C (Nom.) | 10-20 × C | 8-15 × C | >20-25 × C | 14-20 × C | Nb 0.5-1.0 |
| (Pref.) | | | | | Nb 0.65-0.80 |
| | | | | | >20 × C |
| (Pref.) | | | | 16-20 × C | >20-1000 × C |
| (More Pref.) | | | | | >20-500 × C |
| Mn, max. | 1.0 | 1.0 | 1.0 | 1.0 | 1.0 |
| Si, max. | 1.0 | 1.0 | 1.0 | 1.0 | 1.0 |
| V, max. | 0.10 | 0.10 | 0.10 | 0.10 | 0.10 |
| Sn, max. | 0.10 | 0.10 | 0.10 | 0.10 | 0.10 |
| N, max. | 0.030 | 0.030 | 0.030 | 0.030 | 0.030 |
| P, max. | 0.020 | 0.025 | 0.025 | 0.025 | 0.025 |
| S, max. | 0.008 | 0.005 | 0.005 | 0.005 | 0.005 |
| Al, max. | 0.025 | 0.05 | 0.05 | 0.05 | 0.05 |
| Ag, max. | 0.005 | 0.005 | 0.005 | 0.005 | 0.005 |
| Pb, max. | 0.005 | 0.005 | 0.005 | 0.005 | 0.005 |
| Fe | Balance | Balance | Balance | Balance | Balance |

More particularly, this embodiment of the alloy may comprise, by weight: about 14.0 to about 16.0 percent chromium; about 6.0 to about 7.0 percent nickel; about 1.25 to about 1.75 percent copper; about 0.5 to about 1.0 percent molybdenum; about 0.025 to about 0.05 percent carbon; niobium in an amount greater than about twenty times to about twenty-five times that of carbon, and the balance iron and incidental impurities. The discussion above regarding incidental impurities also applies equally to this alloy composition. This alloy composition particularly demonstrates improvements in intergranular corrosion attack resistance that can be realized, for example in comparison with the alloy compositions described in the '305 patent, by increasing the Nb/C ratio to more than about 20, and particularly such that the Nb/C ratio is about 20<Nb/C≤25, as well as increasing the range of the amount of Mo used, particularly such that Mo is, by weight, about 0.5≤Mo≤2.0, as described in Table 1.

Still further, this embodiment of the alloy may comprise, by weight: about 14.0 to about 16.0 percent chromium; about 6.0 to about 7.0 percent nickel; about 1.25 to about 1.75 percent copper; greater than about 1.0 to about 2.0 percent molybdenum; about 0.025 to about 0.05 percent carbon; niobium in an amount greater than about twenty times to about twenty-five times that of carbon, and the balance iron and incidental impurities. The comments made above regarding the incidental impurities also apply equally to this alloy composition. This alloy composition particularly demonstrates improvements in both intergranular corrosion attack and corrosion pitting resistance that can be realized, for example in comparison with the alloy compositions described in the '305 patent, by both increasing the Nb/C ratio to more than about 20, and particularly such that Nb is about 20<Nb/C≤25, as well as increasing the amount of Mo to more than about 1% by weight, particularly such that Mo is, by weight, about 1.0<Mo≤2.0, as described in Table 1.

As shown in Table 1, in a second embodiment, this alloy comprises, by weight, about: about 14.0 to about 16.0 percent chromium; about 6.0 to about 7.0 percent nickel; about 1.25 to about 1.75 percent copper; about >1.0 to about 2.0 percent molybdenum; about 0.025 to about 0.05 percent carbon; niobium in an amount about fourteen to about twenty times that of carbon; and the balance iron and incidental impurities. The comments made above regarding the incidental impurities also apply equally to this alloy composition. This alloy composition particularly demonstrates the improvement in corrosion pitting resistance that can be realized, for example in comparison with the alloy compositions described in the '305 patent, by increasing the amount of Mo to more than about 1% by weight, particularly such that Mo is, by weight, about 1.0<Mo≤2.0, as described in Table 1.

More particularly, this embodiment may comprises, by weight: about 14.0 to about 16.0 percent chromium; about 6.0 to about 7.0 percent nickel; about 1.25 to about 1.75 percent copper; about >1.0 to about 1.75 percent molybdenum; about 0.025 to about 0.05 percent carbon; niobium in an amount about fourteen to about twenty times that of carbon; and the balance iron and incidental impurities. The comments made above regarding the incidental impurities also apply equally to this alloy composition. This alloy composition particularly demonstrates improved intergranular corrosion attack and corrosion pitting resistance that can be realized, for example in comparison with the alloy compositions described in the '305 patent, by both increasing the Nb/C ratio to the highest end of the range described in the '305 patent to enhance the crevice corrosion performance, and particularly such that the Nb/C ratio is about 14≤Nb/C≤20, as well as increasing the amount of Mo to improve the pitting corrosion performance to greater than about 1.0 to about 1.75%, by weight, particularly such that Mo ranges, by weight, from about 1.0<Mo≤1.75 percent, and even more particularly increasing the amount of Mo to improve the pitting corrosion performance to greater than about 1.5 to about 1.75%, by weight, particularly such that Mo ranges, by weight, from about 1.0<Mo≤1.5 percent, as described in Table 1.

As also shown in Table 1, in a third embodiment, this alloy comprises, by weight: about 14.0 to about 16.0 percent chromium; about 6.0 to about 8.0 percent nickel; about 1.25 to about 1.75 percent copper; greater than about 1.5 to about 2.0 percent molybdenum; about 0.001 to about 0.025 percent carbon; about 0.5 to about 1.0 percent niobium; niobium in an amount greater than about twenty times that of carbon; and the balance iron and incidental impurities. The comments made above regarding the incidental impurities also apply equally to this alloy composition. This alloy composition particularly demonstrates the improvement in corrosion high cycle fatigue capability that can be realized, for example, in comparison with the alloy compositions described in the '305 patent, by increasing the amount of Mo to greater than about 1.5% by weight, particularly such that Mo is, by weight, about 1.5<Mo≤2.0, as described in Table 1.

The alloy composition of this embodiment particularly demonstrates improved intergranular corrosion attack resistance, improved corrosion pitting resistance, enhanced high cycle fatigue capability in a corrosive environment and less propensity to form undesirable carbides and undergo carbide segregation that can be realized, for example, by: 1) drastically increasing the Nb/C ratio to greater than 20, more particularly greater than 20 to about 1000, and even more particularly greater than 20 to about 500, through reducing carbon content, by weight, to about 0.025 percent or below, more particularly about 0.002 to about 0.025 percent carbon, and even more particularly about 0.005 to about 0.020 percent carbon, and maintaining niobium content, by weight, of about 0.5 to about 1.0 percent, and more particularly about 0.65 to about 0.80 percent niobium, to enhance IGA resistance and inhibit formation of carbides and carbide segregation; 2) applying cryogenic treatment to insure complete martensitic transformation; as well as 3) increasing the amount of Mo to improve the pitting corrosion performance to greater than about 1.5 to about 2.0%, by weight, particularly such that Mo ranges, by weight, from about 1.5<Mo≤2.0 percent, as described in Table 1.

In view of the above, chromium, nickel, copper, molybdenum, carbon and niobium are required constituents of the stainless steel alloys disclosed herein, and are present in amounts that ensure an essentially martensitic, age-hardened microstructure having about 10% or less by weight of reverted austenite. As in the Custom 450 stainless steel alloy (U.S. Pat. No. 3,574,601) and the alloy disclosed in the '305 patent, copper is critical for forming the copper-rich precipitates required to strengthen the alloy. Notably, the alloy compositions disclosed herein employ a very narrow range for carbon content, even more narrow than that disclosed for the Custom 450 alloy, and a range of Nb/C ratios higher than those disclosed for either the Custom 450 alloy or the alloys disclosed in the '305 patent, and a very limited nitrogen content to promote an impact toughness as described herein. More particularly, nitrogen contents above about 0.03 weight percent will have an unacceptable adverse effect on the fracture toughness of the alloys disclosed herein.

Carbon is an intentional constituent of the alloys disclosed herein as a key element for achieving strength by a mechanism of solution strengthening in addition to the precipitation strengthening mechanism provided by precipitates. However, in comparison to other stainless steels such as Type 422 and Custom 450 (carbon content of 0.10 to 0.20 weight percent), carbon is maintained at impurity-type levels. The limited amount of carbon present in the alloy is stabilized with niobium so as not to form austenite and carefully limit the formation of reverted austenite to the amounts described herein. The relatively high Nb/C ratio is contrary to the teachings of both U.S. Pat. No. 3,574,601 (Custom 450) and the '305 patent, but as described herein is necessary to achieve the improvement in intergranular corrosion attack resistance and maintain a desired level of strength and fracture toughness. In the past, the Nb/C ratio (and niobium amounts), were kept at a level of about 20 or less, and in one embodiment about 15 or less, for various purposes, including achieving a theoretical ratio of about 8:1 required to completely tie up all niobium and carbon, and a ratio up to about 20:1 to achieve tensile strength and impact toughness requirements. The effect of using an amount of Nb sufficient to provide an Nb/C ratio greater than about 20 was not known. The examples given in the '305 patent included several alloys having an Nb/C ratio greater than 20, but they had amounts of various other alloy constituents outside the ranges described herein, and had undesirable alloy mechanical properties. Thus, the impact that niobium in excess of these amounts, and particularly an Nb/C ratio greater than about 20, might have on the corrosion resistance, tensile strength, impact toughness, microstructural morphology, including phases and phase distributions of a precipitation-hardened, martensitic stainless steel, was not known. However, as disclosed herein, it is believed that higher niobium contents (relative to carbon) further impact carbide formation of the other major carbides present in the alloy (e.g., chromium carbides, molybdenum carbides, etc.), and may also influence the precipitation reaction during aging heat treatment, as the Nb/C ratios greater than about 20 have a markedly decreased propensity for sensitization to intergranular corrosion attack associated with the aging temperature of these alloys (i.e., sensitization to intergranular corrosion attack is not a function of aging temperature, or effects related to aging temperature are greatly reduced). At the Nb/C ratios of about 10 to about 20, the propensity to sensitization of the alloy is a function of aging temperature. Applicants have discovered that at Nb/C ratios greater than about 20 and particularly over a range up to a maximum of about 25, tensile strength and fracture toughness, including a UTS of at least about 1100 MPa and a Charpy V-notch toughness of at least about 69 J, that are desirable for turbine compressor airfoils and many other applications, can be obtained by aging at a temperature of about 1000° F. to about 1100° F., and more particularly about 1020° F. to about 1070° F. (about 549° C. to about 576° C.); and even more particularly about 1040° F. to about 1060° F. (about 560° C. to about 571° C.), but that in addition IGA resistance is enhanced, such that these alloys are virtually immune to IGA regardless of the aging temperature, as described herein. Further, Applicants have discovered that a desirable microstructural morphology, particularly the presence of desirable phases and a desirable phase distribution, is realized, including an essentially martensitic microstructural morphology, with about 10% or less, by weight of the alloy, of reverted austenite, particularly adjacent to the grain boundaries, following aging heat treatments of about 1020 to about 1070° F. (about 549 to about 577° C.) for times in the range of about 4 to about 6 hours.

Chromium provides the stainless properties for the alloys disclosed herein, and for this reason a minimum chromium content of about 14 weight percent is required for these alloys. However, as discussed in U.S. Pat. No. 3,574,601, chromium is a ferrite former, and is therefore limited to an amount of about 16 weight percent in the alloy to avoid delta ferrite. The chromium content of the alloy must also be taken into consideration with the nickel content to ensure that the alloy is essentially martensitic. As discussed in U.S. Pat. No. 3,574,601, nickel promotes corrosion resistance and works to balance the martensitic microstructure, but also is an austenite former. The narrow range of about 6.0 to about 7.0 weight percent nickel serves to obtain the desirable effects of nickel and avoid austenite.

As previously reported in the '305 patent, molybdenum also promotes the corrosion resistance of the alloy. However, a relatively narrow range for molybdenum of 0.5-1.0% by weight was specified in the '305 patent, and is currently used in GTD 450 (see Table 1). Therefore, even though the possibility of using up to 2%, and even up to 3% of Mo had been mentioned in the earlier Custom 450 specification ('601 patent), the suitability and affect of using Mo levels above about 1.0% was not known due to the contrary teaching of the '305 patent, and particularly the teaching that the use of Mo in amounts above 1.0% would adversely affect (increase) the formation of delta Mo ferrite, and thus reduce the corrosion resistance of the alloy. Further, the '601 patent encompassed alloys that utilized significantly higher amounts of carbon up to 0.2% max, and a preferred range up to 0.1% max, and did not address by example or otherwise alloy compositions also having in the range of about 0.001% to about 0.050% carbon. This distinction regarding the carbon concentrations in the '601 and '305 patents are important in view of the fact that the interaction of molybdenum and carbon to form molybdenum carbides is believed to play an important role affecting the pitting corrosion pitting resistance of these alloys. Thus, the limitations on the amount of Mo (0.5-1.0%) taught in the '305 patent which specified carbon in a range (0.03-0.05%) that partially overlaps the range (about 0.025 to about 0.05%) of carbon disclosed herein, together with the fact that current commercial practice continues to utilize the same ranges of these constituents, along with the specific teaching that use of higher Mo amounts were undesirable due to the formation of delta Mo ferrite that would diminish the resistance to pitting corrosion, has resulted in the avoidance of development and use of alloys of this type having levels of Mo above about 1.0%. Applicants have surprisingly discovered that use of Mo in amounts, by weight, greater than about 1.0% up to about 2.0% significantly increases the resistance of the alloys disclosed herein to pitting corrosion, rather than adversely affecting the resistance by producing increased amounts of delta Mo ferrite as had been previously believed. More particularly, incorporation of about 1.5 to about 2.0% by weight of Mo is particularly advantageous with regard to increasing the resistance of the alloys disclosed herein to pitting corrosion. This advantageous aspect of the alloys disclosed herein may be used separately to improve the pitting corrosion resistance only, or it may be used in combination with the higher Nb/C ratios disclosed herein to increase the resistance of these alloys to both intergranular and pitting corrosion.

Use of Mo contents in the ranges disclosed in the exemplary embodiments of the alloy compositions disclosed herein produce martensitic microstructures that include ferrite in an amount of about 2% or less by weight. Forming of a ferrite phase (including delta ferrite) in the martensite base microstructure has a detriment to corrosion resistance of the alloys disclosed herein. However, the existence of ferrite, including delta ferrite in an amount of about 2% or less by weight, has a minimal effect on the corrosion resistance and mechanical properties of these alloys.

The addition of Nb and Mo in the amounts described herein may have a propensity to form carbides and to promote segregation in these alloys that have carbon content, by weight, greater than about 0.025 percent, during solidification due to constitutional supercooling. Such segregation is generally undesirable due to the negative effect of segregation on the phase distributions and alloy microstructure, e.g., a reduced propensity to form the desirable martensitic microstructure and an increased propensity to form ferrite or austenite, or a combination thereof. Therefore, reducing carbon content and applying a solution heat treatment prior to aging can reduce the propensity for such segregation.

The addition of Mo and Nb in the amounts described herein may also have a propensity to promote formation of Cr-rich sigma and chi phases in these Cr containing stainless alloys when the alloys experience extended period of aging in temperature range of about 1300 to about 1800° F. These phases are generally undesirable because they can cause alloy embrittlement (reduced toughness) and detrimentally affect alloy corrosion resistance due to Cr depletion of the matrix. Formation of these undesirable phases in the alloys can be avoided by applying a solution heat treatment followed by rapid cooling to room temperature.

Manganese and silicon are not required in the alloy, and vanadium, nitrogen, aluminum, silver, lead, tin, phosphorus and sulfur are all considered to be impurities, and their maximum amounts are to be controlled as described herein. However, as shown in Table 1, both manganese, an austenite former, and silicon, a ferrite former, may be present in the alloy, and when present may be used separately or together at levels sufficient to adjust the balance of ferrite and austenite as disclosed herein along with the other alloy constituents that affect the formation and relative amounts of these phases. Silicon also provides segregation control when melting steels, including the stainless steel alloys disclosed herein.

An important aspect of the alloys disclosed herein is the requirement for a tempering or aging heat treatment. This heat treatment together with the associated cooling of the alloy is the precipitation hardening heat treatment and is responsible for the development of the distributed fine precipitation phases, including Cu-rich precipitates, and other aspects of the alloy microstructure that provide the desirable strength, toughness, corrosion resistance and other properties described herein. This heat treatment may be performed at a temperature from about 1000° F. to about 1100° F. (about 538° C. to about 593° C.) for a duration of at least about 4 hours, and more particularly for a time ranging from about 4 to about 6 hours. More particularly, an aging temperature in the range from about 1005° F. to about 1070° F. (about 541° C. to about 576° C.) may be used. Even more particularly, an aging temperature in the range from about 1005° F. to about 1050° F. (about 541° C. to about 566° C.) may be used. For alloys disclosed herein having lower Nb/C ratios, such as below about 20, and more particularly below about 15, a tempering temperature of about 990° F. to about 1020° F. (about 532° C. to about 549° C.) is preferred to avoid over-aging and increased sensitization to intergranular corrosion attack. Following the aging heat treatment described herein, the alloy is cooled sufficiently to precipitate the distributed fine precipitate phases, including Cu rich precipitates, and other aspects of the alloy microstructure described herein that provide the desirable strength, toughness, corrosion resistance and other properties described herein. Cooling may include cooling an alloy forged preform sufficiently to comprises an essentially martensitic microstructure and having an ultimate tensile strength of at least about 1100 MPa and Charpy V-notch toughness of at least about 69 J.

Otherwise, the stainless steel alloy of this invention can be processed by substantially conventional methods. For example, the alloy may be produced by electric furnace melting with argon oxygen decarburization (AOD) ladle refinement, followed by electro-slag remelting (ESR) of the ingots. Other similar melting practices may also be used. A suitable forming operation may then be employed to produce bar stocks and forgings that have the shape of turbine airfoils or a wrought preform of a turbine airfoil that may be given additional machining or other processing to form a turbine airfoil. The alloy, including components formed therefrom, is solution heat treated at a solutionizing temperature in the range from about 1850° F. to about 1950° F. (about 1010° C. to about 1066° C.) for a solutionizing time of about one to about two hours. The solution heat treatment is sufficient to solutionize the alloy constituents. Solution heat treatment is followed by cooling the alloy at a predetermined cooling rate to a predetermined temperature sufficient to avoid the formation of Cr-rich phases, such as, for example, by cooling the alloy to room temperature at a predetermined cooling rate (e.g., >100° F./minute). Cooling may also include a non-conventional cryogenic treatment that includes cooling the alloy to a cryogenic temperature, including cryogenic temperatures in the range from about −120° F. to about −350° F., to ensure that the alloy microstructure completes the martensite phase transformation and comprises substantially all martensite with substantially no reverted austenite. This cryogenic cooling may be performed in one cooling step or in multiple cooling steps. In one embodiment, cryogenic cooling may be performed in multiple steps and may include rapid cooling at a predetermined cooling rate such as, for example, about 100° F./minute or more, to a predetermined temperature sufficient to avoid the formation of Cr-rich phases (e.g., to room temperature), followed by cooling the alloy to the cryogenic temperature. Cooling at the predetermined cooling rate may be performed in any suitable manner, including forced air (e.g., fan) cooling or liquid (e.g., water) quenching. Following cooling the alloy receives the aging heat treatment described above. The aging heat treatment may be performed at the temperatures and for the times disclosed herein in ambient or vacuum environments to achieve the desirable mechanical properties and corrosion resistance disclosed herein. As indicated herein, in order to reduce the propensity for formation of Cr-rich phases in the alloy microstructure following solution treatment, the alloys described herein will undergo relatively rapid cooling to room temperature following the solution heat treatment. Such cooling may be obtained by any suitable cooling method or means, including, for example, air cooling or fan cooling of the alloys to room temperature. The alloys disclosed herein also undergo a cryogenic cooling treatment following the solution heat treatment and prior to the aging heat treatment to ensure the substantial completion of the martensitic transformation. This may include, for example, cooling the alloys from room temperature to a cryogenic treatment temperature, particularly in temperature range of from about −120° F. to about −350° F., for a time sufficient to ensure that the martensitic transformation is substantially complete. By substantially complete, it is meant that substantially all of the alloy microstructure is transformed to martensite.

The alloys disclosed herein may be used to form turbine airfoil components, including those used for components of industrial gas turbines. A typical turbine airfoil in the form of a turbine compressor blade is well known. A blade has a leading edge, a trailing edge, a tip edge and a blade root, such as a dovetailed root that is adapted for detachable attachment to a turbine disk. The span of a blade extends from the tip edge to the blade root. The surface of the blade comprehended within the span constitutes the airfoil surface of the turbine airfoil. The airfoil surface is that portion of the turbine airfoil that is exposed to the flow path of air from the turbine inlet through the compressor section of the turbine into the combustion chamber and other portions of the turbine. While the alloys disclosed herein are particularly useful for use in turbine airfoils in the form of turbine compressor blades and vanes, they are broadly applicable to all manner of turbine airfoils used in a wide variety of turbine engine components.

These include turbine airfoils associated with turbine compressor vanes and nozzles, shrouds, liners and other turbine airfoils, i.e., turbine components having airfoil surfaces such as diaphragm components, seal components, valve stems, nozzle boxes, nozzle plates, or the like. Also, while these alloys are useful for compressor blades, they can potentially also be used for the turbine components of industrial gas turbines, including blades and vanes, steam turbine buckets and other airfoil components, aircraft engine components, oil and gas machinery components, as well as other applications requiring high tensile strength, fracture toughness and resistance to intergranular and pitting corrosion.

The alloys disclosed herein may be understood by reference to the following examples.

EXAMPLE 1

A screening design of experiments (DOE) study was performed to assess the effects of alloy chemistry, particularly the Nb/C ratio, and aging temperature on the alloy susceptibility or sensitization to IGA. A group of test specimens having compositions within the ranges disclosed herein and having varying Nb/C ratios, Mo contents and aging temperatures as shown in Table 2 were prepared as described herein and subjected to an intergranular corrosion test in accordance with ASTM A262. The degree of sensitization to IGA was assessed by measuring the lineal percentage of the grain boundaries attacked by intergranular corrosion (ditched boundaries) in the specimens. The results of the test are shown in FIGS. 1, 2A, 2B, 2C and 2D which plot the degree of sensitization as a function of the variables described above to identify main effects in accordance with known DOE methodologies. Referring to FIGS. 1, 2A, 2B, 2C and 2D, these results indicate that the Nb/C ratio has a strong effect on the sensitization of these alloys to IGA; and aging temperature has a minor effect on the sensitization of these alloys to IGA. The slope of the curve (FIG. 1) corresponds to the significance of the effect of each variable. The plot reflects the effects of the Nb/C ratio, as described herein, and indicates that increasing the Nb/C ratio decreases the sensitization to IGA. The plot indicates that the alloy compositions with the Nb/C ratio higher than about 17.5 are insensitive to IGA in spite of aging temperature. For lower Nb/C ratios, raising the aging temperature (overaging) increases the sensitization of the alloys to IGA.

TABLE 2

| RunOrder | Specimen | Age Temp | Heat - (Nb + V)/C | Heat - Mo | Sensitization (Ditch %) |
|---|---|---|---|---|---|
| 1 | 3-2 | 1020 | 17.6 | 0.82 | 7 |
| 2 | 4-1 | 950 | 17.7 | 0.83 | 9 |
| 3 | 2-2 | 1020 | 14.8 | 0.81 | 20 |
| 4 | 4-3 | 1150 | 17.7 | 0.83 | 11 |
| 5 | 3-1 | 950 | 17.6 | 0.82 | 3 |
| 6 | 1-3 | 1150 | 10.3 | 0.65 | 88 |
| 7 | 2-3 | 1150 | 14.8 | 0.81 | 48 |
| 8 | 2-1 | 950 | 14.8 | 0.81 | 3 |
| 9 | 4-2 | 1020 | 17.7 | 0.83 | 9 |
| 10 | 1-2 | 1020 | 10.3 | 0.65 | 69 |
| 11 | 3-3 | 1150 | 17.6 | 0.82 | 7 |
| 12 | 1-1 | 950 | 10.3 | 0.65 | 3 |

EXAMPLE 2

A validation DOE study was performed to again assess the effect of alloy chemistry, particularly the Nb/C ratio and Mo content, on the alloy susceptibility or sensitization to IGA. A group of test specimens having compositions within the ranges disclosed herein and having varying Nb/C ratios, Mo contents and the same aging temperature, as shown in Table 3, were prepared as described herein and subjected to an intergranular corrosion test in accordance with ASTM A262.

TABLE 3

| RunOrder | Specimen | Age Temp | (Nb)/C | Mo | Sensitization (Ditch %) |
|---|---|---|---|---|---|
| 1 | 3-1 | 1070 | 9.4 | 2.00 | 71 |
| 2 | 4-1 | 1070 | 20 | 0.62 | 5 |
| 3 | 2-1 | 1070 | 20 | 2.00 | 1 |
| 4 | 1-1 | 1070 | 9.4 | 0.62 | 70 |

Figure 3:
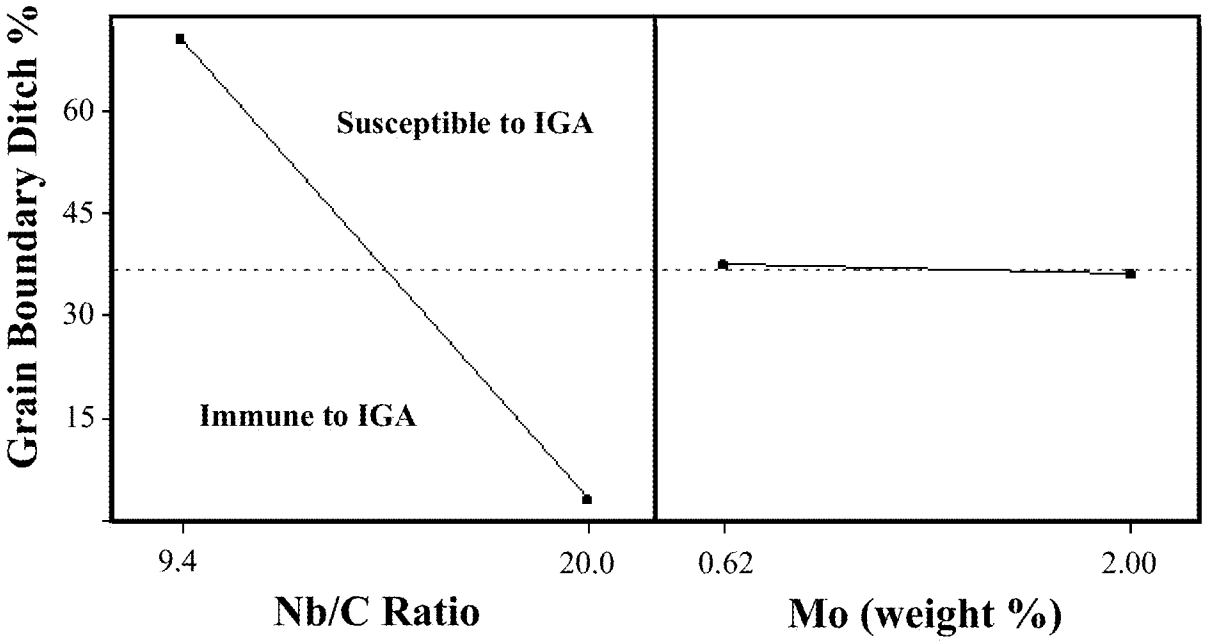
FIG. 3 is a main effects plot of alloy susceptibility to IGA (ditched grain boundary percentage) as a function of the Nb/C ratio and Mo content for alloy compositions as disclosed herein.
Figure 4A:
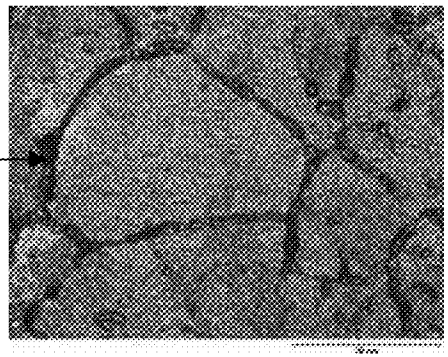
FIGS. 4A-4D show the susceptibility of the microstructure to IGA (affected vs immune), as a function of the Nb/C ratio and Mo content for alloy compositions as disclosed herein.
Figure 4B:
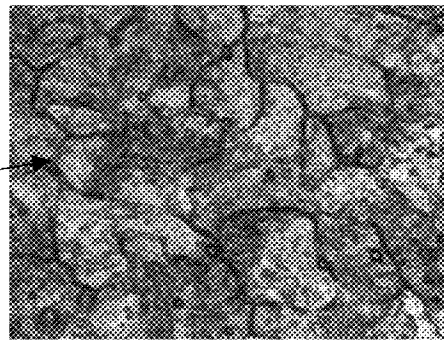
Figure 4C:
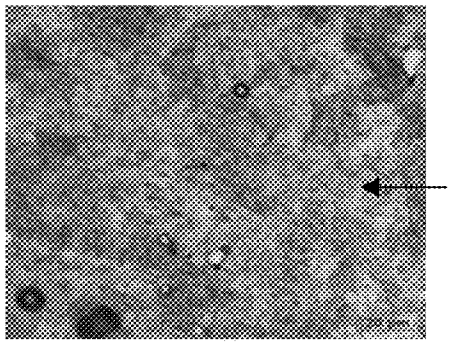
Figure 4D:
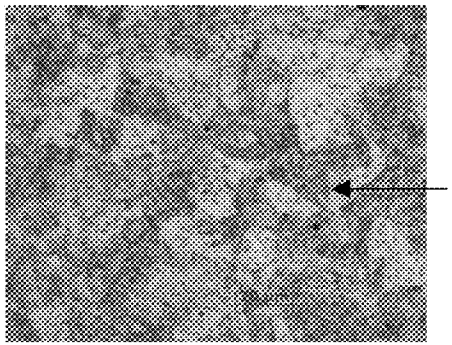
Figure 7:
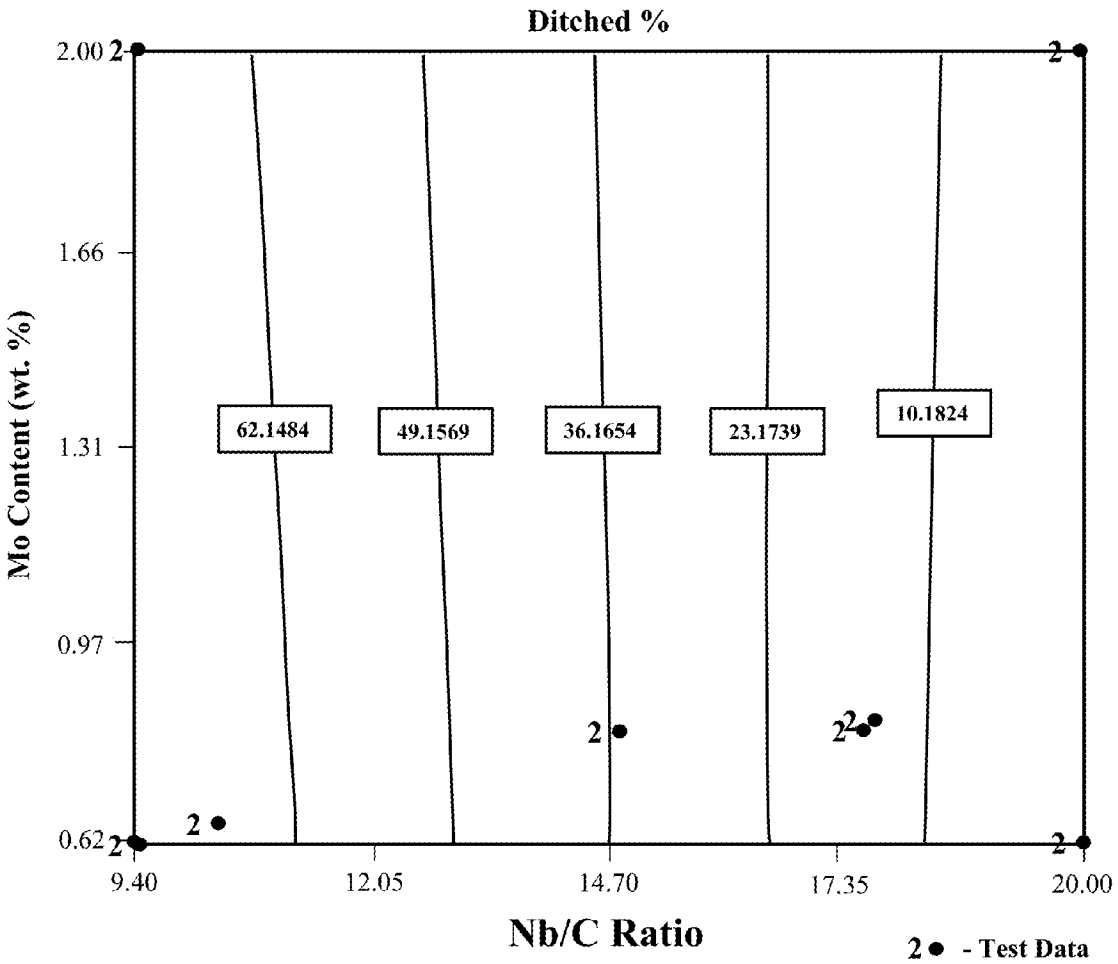
FIG. 7 is a plot developed from a quantitative analysis of alloy microstructures illustrating susceptibility to IGA (Ditching %) as a function of the Nb/C ratio and Mo content for alloy compositions as disclosed herein.
Figure 8:
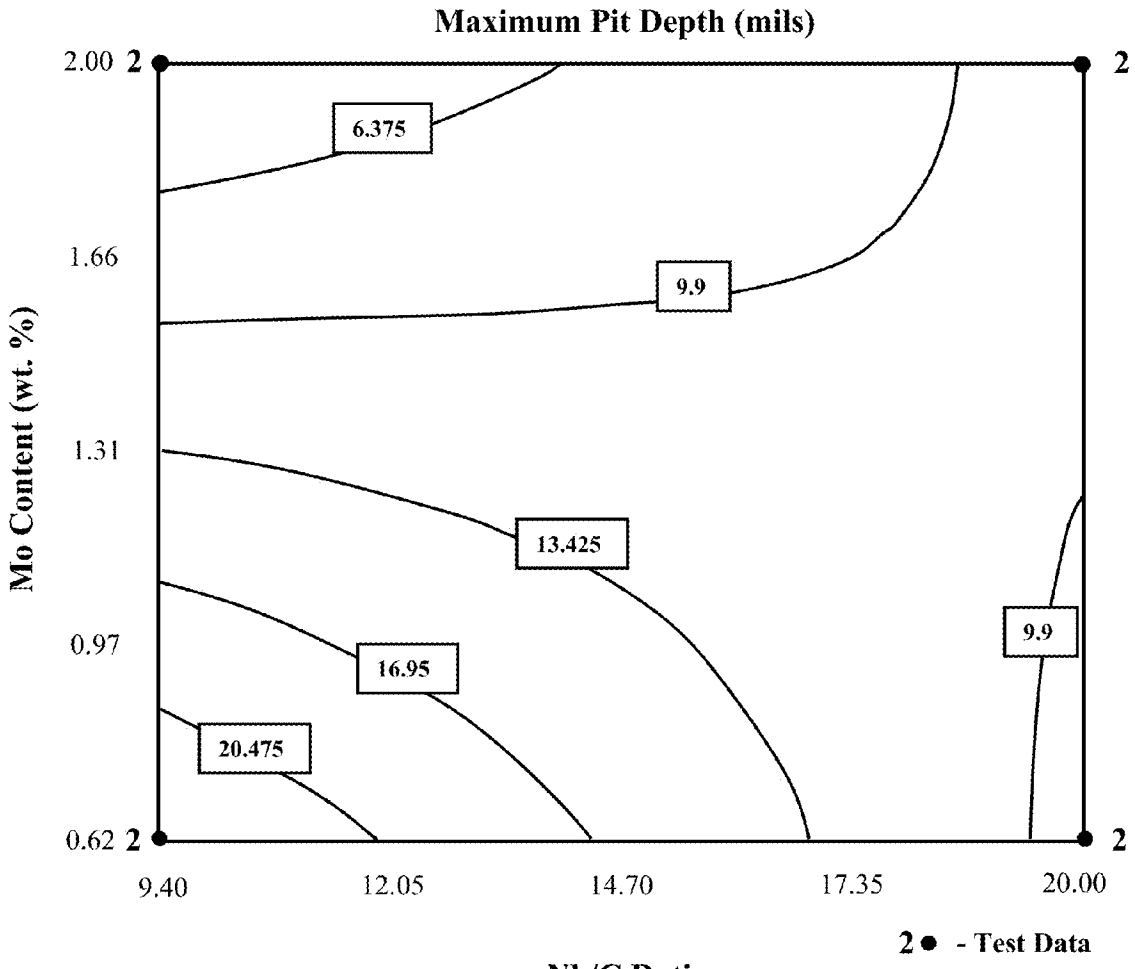
FIG. 8 is a plot developed from a quantitative analysis of alloy microstructures illustrating susceptibility to corrosion pitting (pitting depth) as a function of the Nb/C ratio and Mo content for alloy compositions as disclosed herein.

The degree of sensitization to IGA was assessed by measuring the percentage of the lineal extent of grain boundaries attacked by corrosion (ditched boundaries) in the specimens with reference to the total lineal measurement of the grain boundaries. Per the ASTM test, sensitization is defined as at least one completely ditched grain boundary, i.e., a grain boundary completely surrounded by IGA. The results of the test are shown in FIGS. 3 and 4 which plot the degree of sensitization as a function of the variables described above to identify main effects in accordance with known DOE methodologies. An analysis of the data from the two DOE studies was performed to show the combined effects of the variables on IGA resistance of the alloy compositions described herein. The result of the analysis is given in FIG. 7. Referring to FIGS. 3, 4 and 7, the results also indicate that increasing the Nb/C ratio decreases the sensitization to IGA, with an Nb/C of about 20 or less having a sensitization (ditched grain boundaries) less than about 5%. With the Nb/C ratios higher than about 20, the alloys show immunity to IGA in spite of aging temperature. With the Nb/C ratio less than 14, the alloys are susceptible to IGA especially when overaged (having ditched grain boundaries more than about 30%). The Mo content did not show any notable effect on susceptibility of the alloys to IGA.

EXAMPLE 3

A standard accelerated salt fog test per ASTM G85 A4 was carried out to assess the effect of alloy chemistry, particularly the Mo content and Nb/C ratio, on the alloy corrosion pitting resistance. A group of test specimens having compositions within the ranges disclosed herein and having varying Mo contents and Nb/C ratios and the same aging temperature, as shown in Table 3, were prepared as described herein and subjected to 5% NaCl and pH 3 salt fog exposure for a duration up to about 1992 hours.

Figure 5:
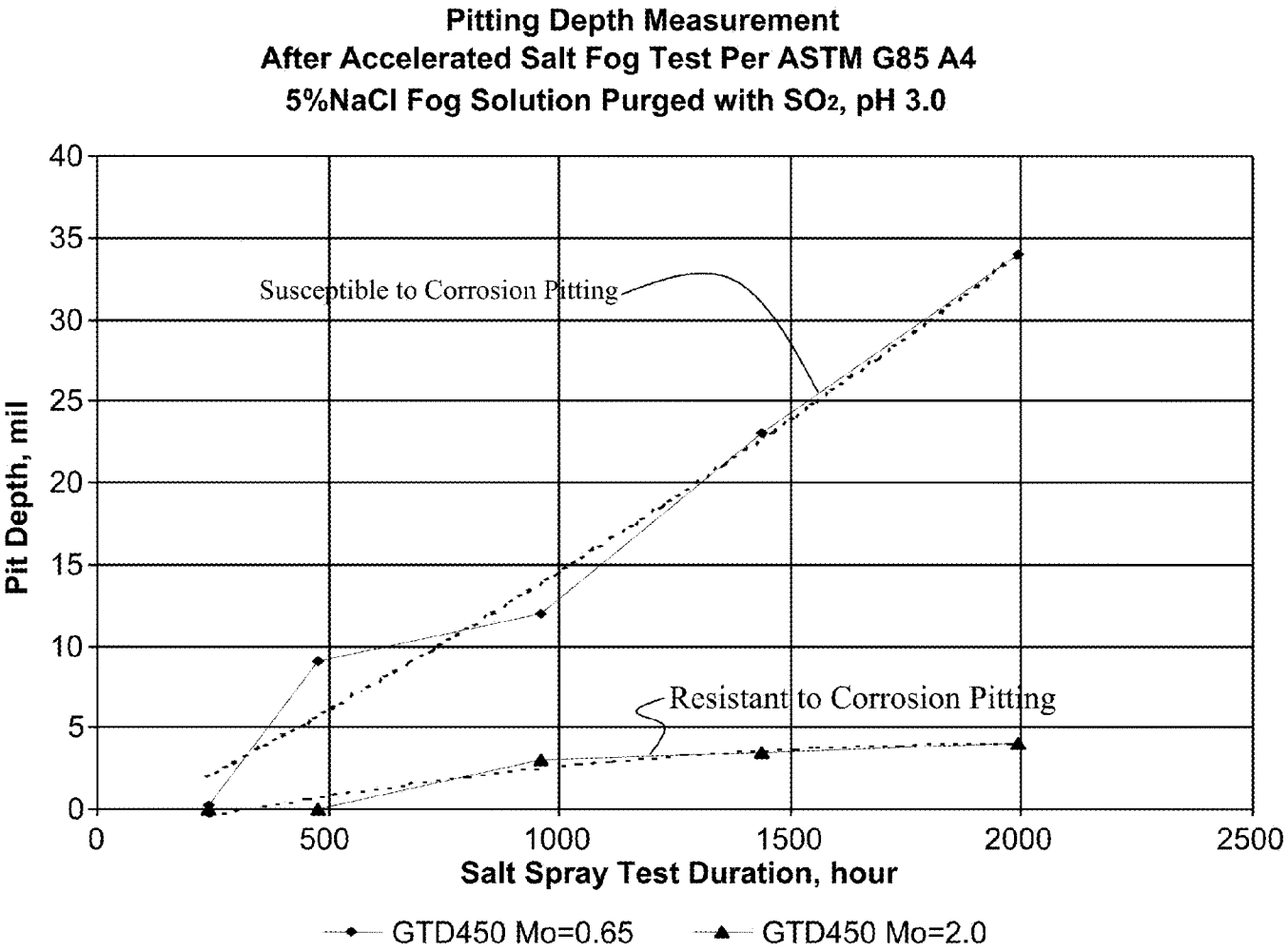
FIG. 5 is a plot of alloy corrosion pitting growth rate (maximum pit depth vs. exposure time) as a function of the Mo content for alloy compositions as disclosed herein.
Figure 6A:
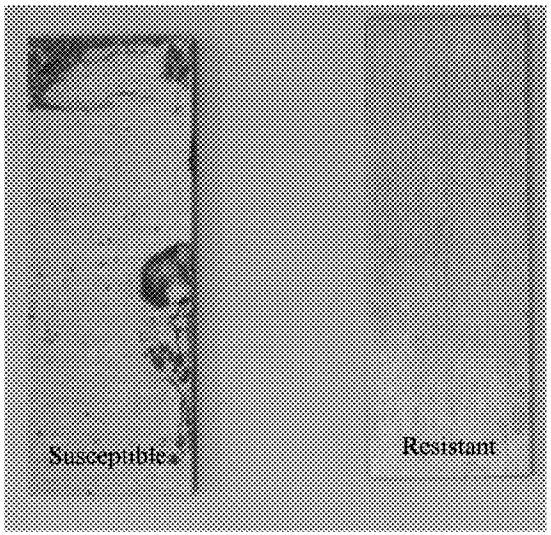
FIGS. 6A and 6B show corrosion pitting resistance (susceptible vs. resistant) as a function of Mo content for alloy compositions as disclosed herein.
Figure 6B:
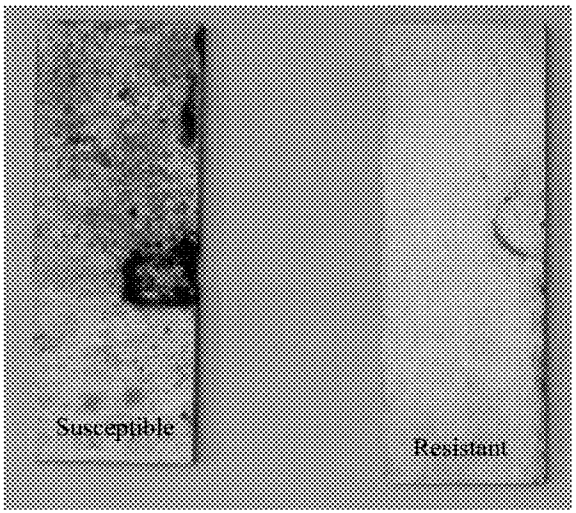

The degree of resistance to corrosion pitting was assessed by measuring the maximum pitting depth of the specimens after a given time of exposure. The results of the test given in FIGS. 5, 6A and 6B show the pitting depth growth rate and pitting density comparison as function of the Mo content of the alloy compositions described herein. Referring to FIGS. 5, 6A, 6B and 8, the results indicate that increasing the Mo content of the alloy compositions described herein significantly improves the corrosion pitting resistance. With an addition of 2% Mo the alloy described herein showed better corrosion pitting resistance (the maximum pit depth only about 3.5 mils after about 1992 hours of salt fog exposure and low pitting density after 1440 hours of exposure) than the current version of GTD450 with about 0.62% of Mo content (the maximum pit depth about 34 mils after about 1992 hours of salt fog exposure, and high pitting density after about 480 hours of salt fog exposure). The Nb/C ratio did not show any notable effect on corrosion pitting resistance of the alloy.

A statistical analysis using Design Expert from StatEase to model the best compositional balance of the alloy was performed based on the test data described above. The analysis results suggest that the optimized compositions of the alloy would be the Nb/C ratio greater than about 20 and the Mo content at about 1.5%.

EXAMPLE 4

Figure 9:
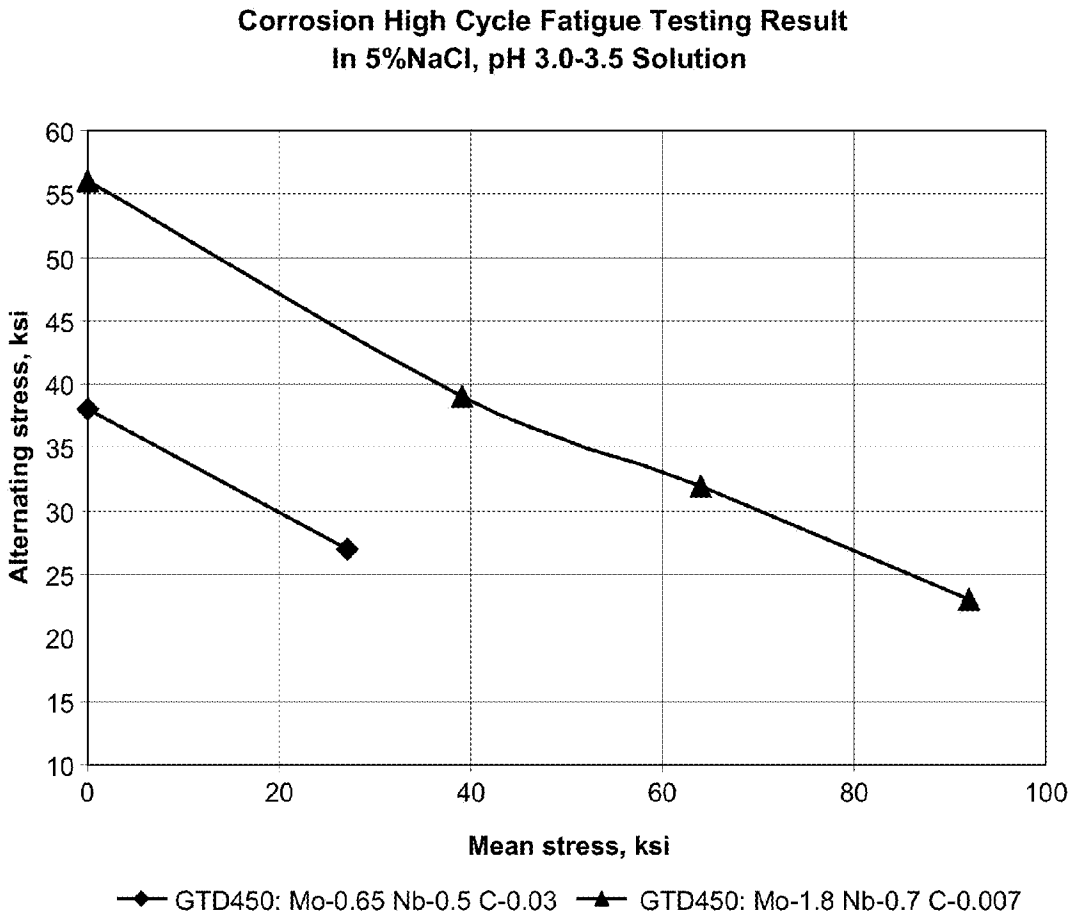
FIG. 9 is a plot illustrating alloy corrosion high cycle fatigue capability (i.e., fatigue strength in corrosive environment) as a function of the Mo content, Nb/C ratio and property treatment method for alloy compositions as disclosed herein.

Corrosion high cycle fatigue tests were performed to assess the effect of alloy chemistry, particularly the Nb/C ratio and Mo content, on the capability of the alloy to withstand cyclic stress in corrosive environment, particularly where the alloy has a carbon content, by weight, below about 0.025 percent. A group of test specimens having compositions within the ranges disclosed herein and having varying Nb/C ratio and Mo contents and the same hardness as shown in Table 4 were prepared as described herein and subjected to a high cycle fatigue test per ASTM E466 in 5% NaCl aqueous solution having a pH of about 3 to about 3.5. The high cycle fatigue capability was assessed by determining the highest cyclic stress that a specimen could endure for 20 million cycles without cracking. The results of the test are given in FIG. 9 which shows the high cycle fatigue capability comparison as a function of the chemistry variation of the alloy compositions described herein. Referring to FIG. 9, the results indicate that increasing the Mo content and Nb/C ratio of the alloy compositions described herein significantly improves the high cycle fatigue capability in a corrosive environment.

TABLE 4

| Test | Specimen | Hardness $R_c$ | (Nb)/C | Mo | A ratio | Corrosion HCF Endurance limit, ksi |
|---|---|---|---|---|---|---|
| 1 | GTD450+ | 36.0 | 100 | 1.8 | Infinity | 56 |
| 2 | GTD450 | 36.0 | 16.7 | 0.62 | Infinity | 38 |
| 3 | GTD450+ | 36.0 | 100 | 1.8 | 1 | 39 |
| 4 | GTD450 | 36.0 | 16.7 | 0.62 | 1 | 27 |

Figure 10:
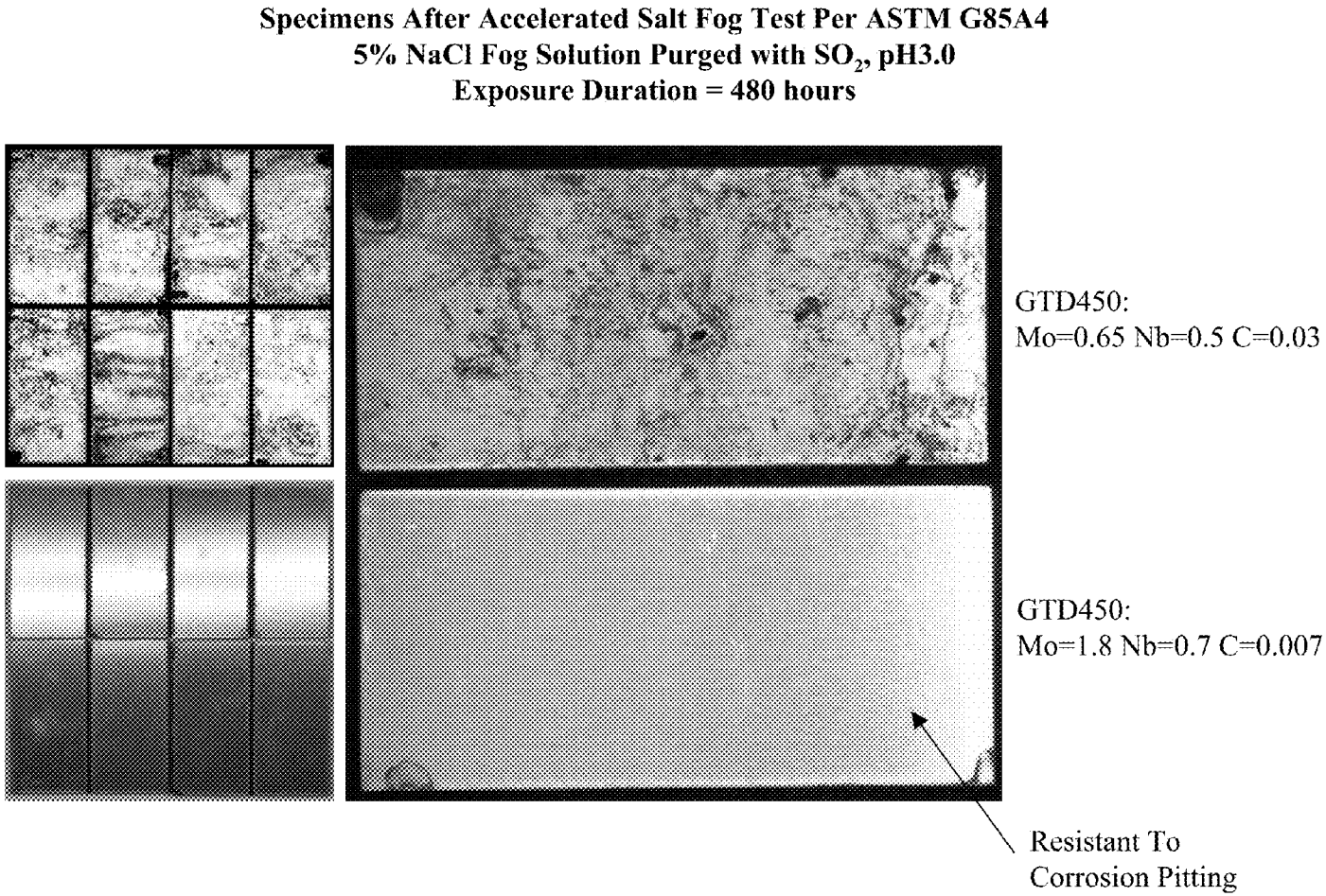
FIG. 10 illustrates corrosion pitting resistance (e.g., susceptible vs. resistant) as a function of Mo content, Nb/C ratio and property treatment method for alloy compositions as disclosed herein.

An additional accelerated salt fog test per ASTM G85 A4 was also carried out to assess the effect of alloy chemistry, particularly the Mo content, on the corrosion pitting resistance of the alloy, which has carbon content, by weight, below about 0.025 percent. A group of test specimens having compositions within the ranges disclosed herein and having varying Mo contents prepared as described herein were subjected to 5% NaCl aqueous solution having a pH 3 as a salt fog for a duration of about 480 hours. The results of the test illustrated in FIG. 10 show pitting density comparison as function of Mo content of the alloy compositions described herein. Referring to FIG. 10, the results indicate that increasing the Mo content of the alloy compositions described herein significantly improves the corrosion pitting resistance. With an addition of 1.8% Mo the alloy, which has 0.007 percent C, described herein showed better corrosion pitting resistance (having no corrosion pit after 480 hours of salt exposure) than the current version of GTD450 with about 0.65% of Mo content, which shows corrosion pits up to 8 mils deep, and a higher pitting density after 480 hours of salt fog exposure.

Figure 11A:
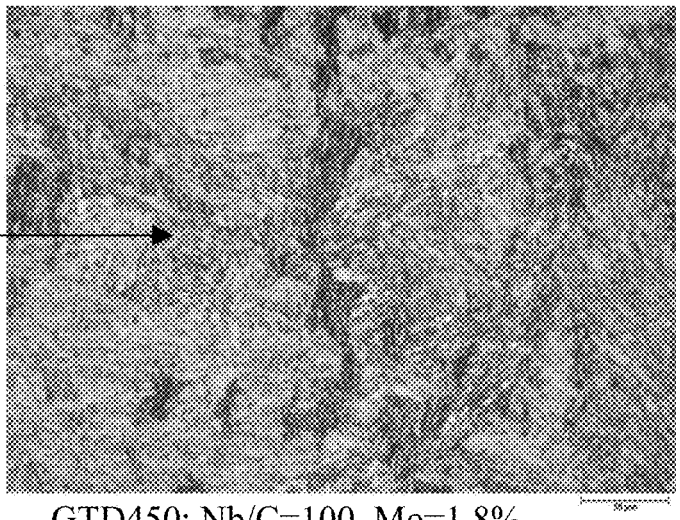
FIGS. 11A and 11B illustrate the resistance of the alloy microstructure to IGA as a function of the Nb/C ratio (e.g., >20) and property treatment method for alloy compositions as disclosed herein.
Figure 11B:
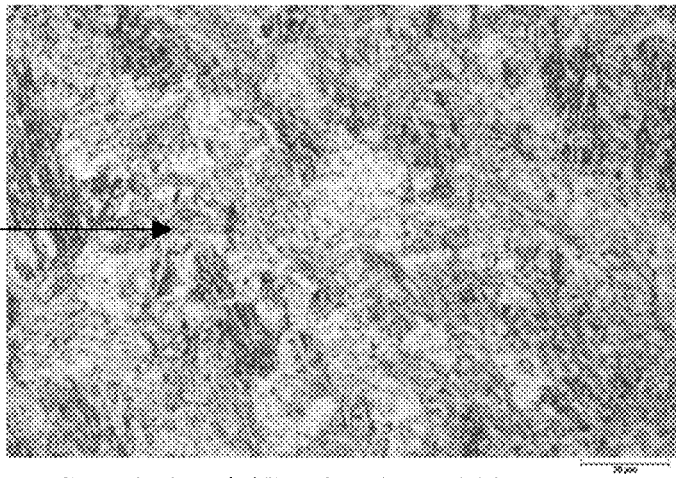

An additional intergranular corrosion test in accordance with ASTM A262 was also performed to assess the susceptibility to IGA of the alloy, which has carbon content, by weight, below about 0.025 percent. A group of test specimens having Mo, by weight, of about 1.8-1.9 Nb/C greater than 20 (e.g., 78 (FIG. 11B) and 100 (FIG. 11A)) and having carbon content below about 0.025 percent (e.g., 0.009 percent (FIG. 11B) and 0.007 percent (FIG. 11A)) and compositions within the ranges disclosed herein were prepared and subjected to an intergranular corrosion test as described herein. The results of the test are illustrated in FIGS. 11A and 11B, show the microstructure of the alloys after the intergranular corrosion test. Referring to FIGS. 11A and 11B, the results indicate that with the Nb/C ratios higher than 20, although the carbon content are below 0.025, the alloys show immunity to IGA.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of constituents of an alloy composition is applied to all of the listed constituents, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the alloy compositions described herein specifically discloses and includes the embodiments wherein the alloy compositions "consist essentially of" the named components (i.e., contain the named components and no other components that significantly adversely affect the basic and novel features disclosed), and embodiments wherein the alloy compositions "consist of" the named components (i.e., contain only the named components except for contaminants which are naturally and inevitably present in each of the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A forged or wrought precipitation-hardened stainless steel alloy comprising, by weight: about 14.0 to about 16.0 percent chromium; about 6.0 to about 8.0 percent nickel; about 1.25 to about 1.75 percent copper; greater than 1.5 percent to about 2.0 percent molybdenum; about 0.001 to about 0.025 percent carbon; greater than or equal to 0.625 to about 1.0 percent niobium; niobium in an amount greater than about twenty times that of carbon and the balance iron and incidental impurities.

2. The precipitation-hardened stainless steel alloy of claim 1, wherein the alloy comprises, by weight, about 0.002 to about 0.025 percent carbon.

3. The precipitation-hardened stainless steel alloy of claim 1, wherein the alloy comprises, by weight, about 0.005 to about 0.020 percent carbon.

4. The precipitation-hardened stainless steel alloy of claim 1, wherein the alloy comprises, by weight, about 0.65 percent to about 0.80 percent niobium.

5. The precipitation-hardened stainless steel alloy of claim 1, wherein the alloy comprises niobium in an amount greater than about twenty times to about one thousand times that of carbon.

6. The precipitation-hardened stainless steel alloy of claim 1, wherein the alloy comprises niobium in an amount greater than about twenty times to about five hundred times that of carbon.

7. The precipitation-hardened stainless steel alloy of claim 1, wherein the alloy has an ultimate tensile strength of at least about 1100 MPa and Charpy V-notch toughness of at least about 69 J.

8. The precipitation-hardened stainless steel alloy of claim 1, wherein the alloy has a microstructure comprising substantially all martensite.

9. The precipitation-hardened stainless steel alloy of claim 1, wherein the alloy has a microstructure comprising substantially no reverted austenite.

10. The precipitation-hardened stainless steel alloy of claim 1, wherein alloy comprises a forged or wrought alloy preform.

11. The precipitation-hardened stainless steel alloy of claim 1, wherein the alloy comprises a turbine airfoil.

12. The precipitation-hardened stainless steel alloy of claim 1, further comprising not greater than about 1.0 percent manganese; not greater than about 1.0percent silicon; not greater than about 0.1 percent vanadium; not greater than about 0.1percent tin; not greater than about 0.030 percent nitrogen; not greater than about 0.025percent phosphorus; not greater than about 0.005 percent sulfur; not greater than about 0.05 percent aluminum; not greater than about 0.005 percent silver and not greater than about 0.005 percent lead as incidental impurities.

13. A method of making a forged precipitation-hardened stainless steel alloy, comprising:

providing a forged or wrought precipitation-hardened stainless steel alloy comprising, by weight: about 14.0 to about 16.0 percent chromium; about 6.0 to about 8.0 percent nickel; about 1.25 to about 1.75 percent copper; greater than 1.5 to about 2.0percent molybdenum; about 0.001 to about 0.025 percent carbon; greater than or equal to 0.625 to about 1.0 percent niobium; niobium in an amount greater than about twenty times that of carbon and the balance iron and incidental impurities;

solution heat treating the alloy at a solutionizing temperature and time sufficient to solutionize the alloy constituents;

cooling the alloy to a cryogenic temperature following the solution heat treating and prior to aging the alloy; and aging the alloy at an aging temperature sufficient to form precipitates configured to provide precipitation hardening of the alloy, wherein the alloy has a microstructure comprising substantially all martensite, an ultimate tensile strength of at least about 1100MPa and Charpy V-notch toughness of at least about 69 J.

14. The method of claim 13, wherein the solutionizing temperature is from about 1850° F. to about 1950° F. and the solutionizing time is from one to about two hours.

15. The method of claim 13, wherein the cryogenic temperature is about -120° F. to about -350° F.

16. The method of claim 13, wherein the aging temperature is about 1000° F. to about 1100° F.

17. The method of claim 13, wherein the aging temperature is in the range of about 1005° F. to about 1070° F.

18. The method of claim 13, wherein cooling the alloy to a cryogenic temperature comprises:

cooling the alloy at a predetermined controlled cooling rate to an ambient temperature; and cooling the alloy to the cryogenic temperature.

19. The method of claim 13, wherein providing a forged or wrought precipitation-hardened stainless steel alloy further comprises forming a forged or wrought preform from the alloy.

20. The method of claim 14, wherein forming a forged or wrought preform from the alloy comprises forming a turbine airfoil preform.

* * * * *